US009416784B2

(12) United States Patent
Sakaguchi et al.

(10) Patent No.: US 9,416,784 B2
(45) Date of Patent: Aug. 16, 2016

(54) EXHAUST PUMP

(75) Inventors: Yoshiyuki Sakaguchi, Urayasushi (JP); Akihiro Ito, Funabashi (JP); Akihiko Wada, Funabashi (JP)

(73) Assignee: Edwards Japan Limited, Chiba (JP)

( * ) Notice: Subject to any disclaimer, the term of this patent is extended or adjusted under 35 U.S.C. 154(b) by 719 days.

(21) Appl. No.: 13/822,230

(22) PCT Filed: Jul. 25, 2011

(86) PCT No.: PCT/JP2011/066862

§ 371 (c)(1),
(2), (4) Date: Mar. 11, 2013

(87) PCT Pub. No.: WO2012/043035

PCT Pub. Date: Apr. 5, 2012

(65) Prior Publication Data

US 2013/0170955 A1 Jul. 4, 2013

(30) Foreign Application Priority Data

Sep. 28, 2010 (JP) ..... 2010-216910

(51) Int. Cl.

| | |
|---|---|
| ***F01D 1/36*** | (2006.01) |
| ***F04B 35/04*** | (2006.01) |
| ***F04D 3/00*** | (2006.01) |
| ***F04D 19/04*** | (2006.01) |
| ***F04D 29/64*** | (2006.01) |

(52) U.S. Cl.

CPC ..... *F04D 3/00* (2013.01); *F04D 19/042* (2013.01); *F04D 19/044* (2013.01); *F04D 29/644* (2013.01)

(58) Field of Classification Search

CPC ... F04D 19/042; F04D 19/044; F04D 29/644; F04D 3/00

See application file for complete search history.

(56) References Cited

FOREIGN PATENT DOCUMENTS

| | | | | |
|---|---|---|---|---|
| JP | DE 4113122 A1 * | 10/1991 | ..... | F04D 19/044 |
| JP | H04-6593 U | 1/1992 | | |
| JP | H05-38389 U | 5/1993 | | |

OTHER PUBLICATIONS

Machine Translation of DE 4113122 A1.*

International Search Report from PCT Application No. PCT/JP2011/066862, dated Oct. 11, 2011.

International Written Opinion from PCT Application No. PCT/JP2011/066862, dated Oct. 11, 2011.

* cited by examiner

*Primary Examiner* — Thai Ba Trieu

*Assistant Examiner* — Brandon Lee

(74) *Attorney, Agent, or Firm* — Westman, Champlin & Koehler, P.A.

(57) ABSTRACT

Provided is an exhaust pump that comprises connecting opening portions that can be deburred easily and that are suitable for enhancing gas evacuation performance. A rotor (a cylindrical rotating member) of an exhaust pump comprises a plate body that has a ring-like projection on a reverse side outer peripheral section of the rotor, and a cylindrical body that is fitted into an outer periphery of the ring-like projection. Connecting opening portions of the exhaust pump comprise holes that are formed by notching an outer peripheral section of the plate body and an outer peripheral section of the ring-like projection, and a portion (specifically, a hole) of the holes that opens in the form of a horizontal hole is covered by an outer-peripheral upper end portion of the cylindrical body.

3 Claims, 6 Drawing Sheets

(a)

(b)

(c)

EXHAUST PUMP

BACKGROUND OF THE INVENTION

1. Field of the Invention

The present invention relates to an exhaust pump that is used, as gas evacuation means or the like, in a process chamber of a semiconductor manufacturing apparatus, a flat panel display manufacturing apparatus or a solar panel manufacturing apparatus, and in other sealed chamber. More particularly, the invention relates to an exhaust pump provided with connecting opening portions that can be deburred easily and that are suitable for enhancing gas evacuation performance.

2. Description of the Related Art

One known method for enhancing the evacuation performance of an exhaust pump of a type where gas is evacuated by using a thread groove, but without modifying the overall size of the pump, is, for instance, the method disclosed in Japanese Unexamined Utility Model Application Laid-open No. H5-38389.

In this method, as illustrated in FIG. 1 of Japanese Unexamined Utility Model Application Laid-open No. H5-38389, thread grooves (30, 31) are provided at the outer periphery and the inner periphery of a cylindrical rotating member (4*a*). As a result, a helical outer thread groove exhaust passage becomes formed between the cylindrical rotating member (4*a*) and an outer cylindrical fixed member (33) that surrounds the outer periphery of the cylindrical rotating member (4*a*), and a helical inner thread groove exhaust passage becomes formed between the cylindrical rotating member (4*a*) and an inner cylindrical fixed member (7) that surrounds the inner periphery of the cylindrical rotating member (4*a*), such that gas molecules are evacuated in parallel along these inner and outer thread groove exhaust passages (parallel-flow evacuation scheme).

In order to lead the gas molecules to the inner thread groove exhaust passage in the exhaust pump that relies on the above parallel-flow evacuation scheme, a configuration is resorted to wherein connecting opening portions (4*b*) are opened in the cylindrical rotating member (4*a*) (FIG. 1 in Japanese Unexamined Utility Model Application Laid-open No. H5-38389). Rotor blades (5) exist above the upstream end of the connecting opening portions (4*b*), and hence the connecting opening portions (4*b*), if any, are formed through drilling by inserting a long tool, from the inward side of the cylindrical rotating member (4*a*).

In a method where the connecting opening portions (4*b*) are formed through such drilling, however, burr forms at the upstream end of the connecting opening portions (4*b*). If the abovementioned rotor blades (5) exist on the upstream end side of the connecting opening portions (4*b*), therefore, the rotor blades (5) hamper the deburring operation, and it is no longer possible to remove burr in a simple manner.

The exhaust pump that utilizes the abovementioned parallel-flow evacuation scheme has enhanced evacuation performance. However, recent years have witnessed an increase in the size of the sealed chambers, and in the amount of gases, such as reactive gases and the like, that are used in these chambers, as dictated by the increase in size of the semiconductors, flat panels, solar panels and the like that are produced in such sealed chambers. Accordingly, yet better evacuation performance is required from exhaust pumps as means for evacuating such gases.

The reference numerals in brackets in the explanation above denote reference numerals used in Japanese Unexamined Utility Model Application Laid-open No. H5-38389.

SUMMARY OF THE INVENTION

In order to solve the above problems and meet the above demands, it is an object of the present invention to provide an exhaust pump that comprises connecting opening portions that can be deburred easily and that are suitable for enhancing gas evacuation performance.

In order to attain the above goal, the present invention involves an exhaust pump that includes: a cylindrical rotating member; support means for rotatably supporting the cylindrical rotating member about an axis thereof; driving means for rotationally driving the cylindrical rotating member; an outer cylindrical fixed member disposed so as to surround an outer periphery of the cylindrical rotating member; an inner cylindrical fixed member disposed so as to surround an inner periphery of the cylindrical rotating member; a helical outer thread groove exhaust passage provided between the cylindrical rotating member and the outer cylindrical fixed member; a helical inner thread groove exhaust passage provided between the cylindrical rotating member and the inner cylindrical fixed member; and connecting opening portions that are opened in the cylindrical rotating member and that lead a part of gas existing in the vicinity of the outer periphery of the cylindrical rotating member to the inner thread groove exhaust passage, wherein the cylindrical rotating member has a plate body having a ring-like projection at a reverse side outer peripheral section of the cylindrical rotating member, and a cylindrical body that is fitted into an outer periphery of the ring-like projection; and each of the connecting opening portions has a structure that has holes formed by notching an outer peripheral section of the plate body and an outer peripheral section of the ring-like projection, and a portion of all holes that opens in the form of a horizontal hole is covered by an outer-peripheral upper end portion of the cylindrical body.

In the present invention, of the entirety of the cylindrical rotating member, the plate body and the ring-like projection, may be made of a metal material, and the cylindrical body may be made of a high-strength plastic material.

In the present invention, the plate body may be formed in a ring shape, and a mass addition groove for balance adjustment of the cylindrical rotating member may be provided in the inner peripheral face of the plate body.

As a specific configuration of the connecting opening portions for introducing a part of the gas into the inner thread groove exhaust passage, a configuration is resorted to, in the present invention, wherein the connecting opening portions comprise holes that are cut out from an outer peripheral section of the plate body and from an outer peripheral section of the ring-like projection, and a portion of the combined the holes that opens in the form of a horizontal hole is covered by an outer-peripheral upper end portion of the cylindrical body. The following effects are elicited as a result.

(1) The operation of removing burr generated during the formation process of the holes can be performed beforehand, prior to fitting of the cylindrical body onto the outer periphery of the ring-like projection. Burr can be easily removed in such an instance by inserting a deburring tool into the holes through the portion of the combined the holes that opens in the form of a horizontal hole. Deburring ability is thus good.

(2) The portion of the combined the holes that opens in the form of a horizontal hole is covered by the outer-peripheral upper end portion of the cylindrical body. Therefore, the gas evacuation action elicited by a drag effect is likewise effective at that portion, as part of the outer thread groove exhaust passage, and gas evacuation performance is enhanced.

(3) The holes can be formed by bringing a tool close to the vicinity of a boundary between the plate body and the ring-like projection, from the outer periphery of the plate body. As a result, rotor blades do not become an obstacle during the formation of the holes, also in exhaust pump of a form wherein rotor blades exist above the portion of the combined the holes that opens in the form of a vertical hole. Connecting opening portions that comprise such holes can be thus formed easily.

DESCRIPTION OF THE PREFERRED EMBODIMENTS

Embodiments of the present invention are explained next with reference to drawings that accompany the specification.

First Embodiment

Figure 1:
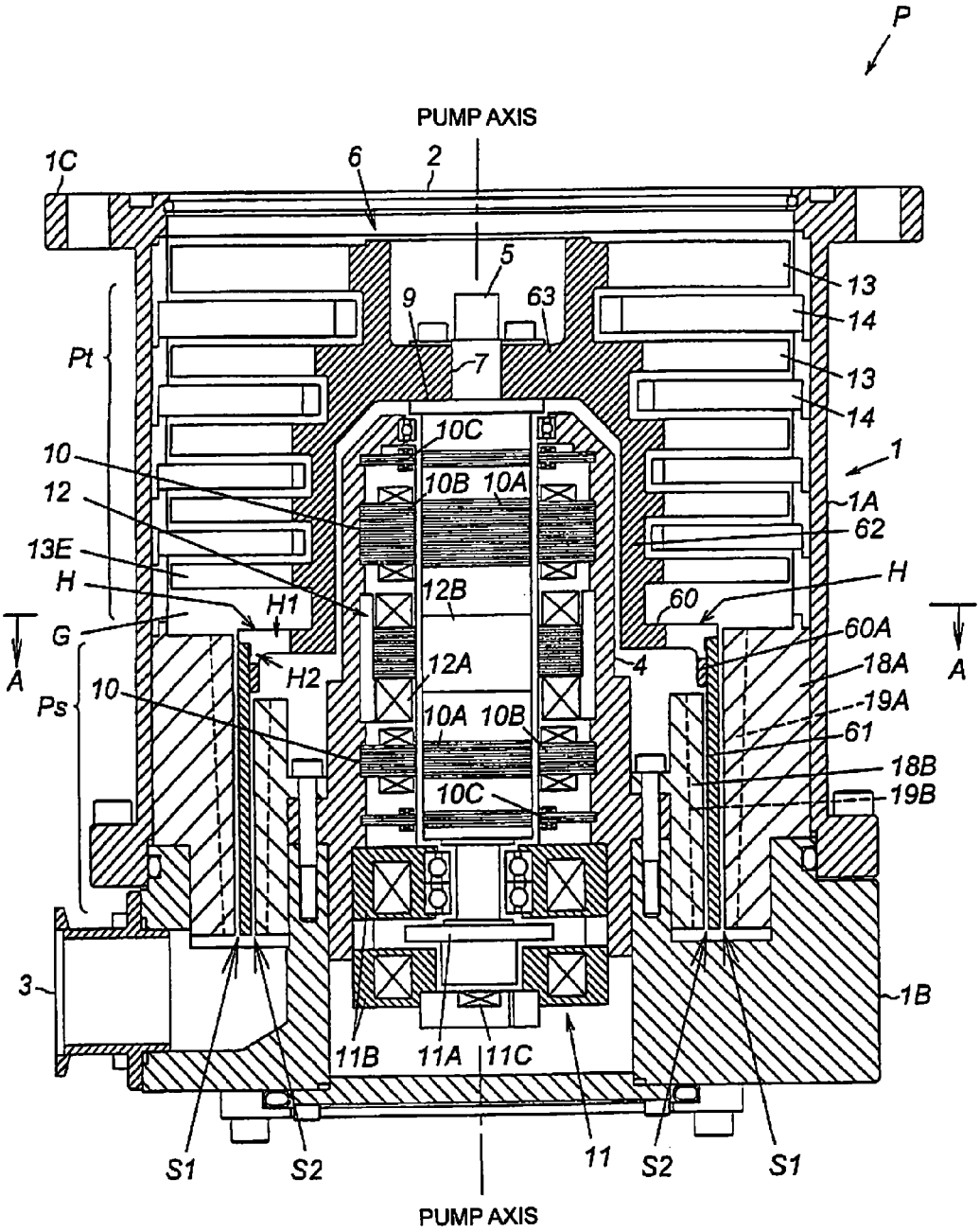
FIG. 1 is a cross-sectional diagram of an exhaust pump being a first embodiment of the present invention.

FIG. 1 is a cross-sectional diagram illustrating the an exhaust pump according to a first embodiment of the present invention. An exhaust pump P in the figure is used as gas evacuation means in, for instance, a process chamber in a semiconductor manufacturing apparatus, a flat panel display manufacturing apparatus, a solar panel manufacturing apparatus, and in other sealed chambers. The exhaust pump has an outer case 1, and in the interior thereof: a blade evacuation section Pt that evacuates gas by means of rotor blades 13 and stator blades 14; a thread groove evacuation section Ps that evacuates gas by way of thread grooves 19A and 19B; and a driving system of the foregoing.

The outer case 1 is a bottomed cylinder wherein a cylindrical pump case 1A and a bottomed cylindrical pump base 1B are integrally connected, by bolts, in the cylinder axial direction. The upper end portion side of the pump case 1A is opened in the form of a gas intake port 2. A gas discharge port 3 is provided at the lower end portion side face of the pump base 1B.

The gas intake port 2 is connected to a sealed chamber, not shown, at high vacuum, for instance a process chamber of a semiconductor manufacturing apparatus, by way of bolts, not shown, that are provided in a flange 1C at the upper edge of the pump case 1A. The gas discharge port 3 is connected in such a way so as to communicate with an auxiliary pump not shown.

A cylindrical stator column 4, into which various electrical components are built, is provided in the central portion of the pump case 1A. The stator column 4 is erected on the pump base 1B through screwing of the lower end side of the stator column 4 to the pump base 1B.

A rotor shaft 5 is provided inside the stator column 4. The rotor shaft 5 is disposed in such a manner that the upper end portion thereof points towards the gas intake port 2 and the lower end portion thereof points towards the pump base 1B. The rotor shaft 5 is provided in such a manner that the upper end portion thereof protrudes above the upper end face of the cylinder of the stator column 4.

The rotor shaft 5 is rotatably supported, in the radial direction and in the axial direction, by radial magnetic bearings 10 and axial magnetic bearings 11, so that, in that state, the rotor shaft 5 is rotationally driven by a driving motor 12.

The driving motor 12 is a structure that comprises a stator 12A and a rotor 12B, and is provided substantially in the vicinity of the center of the rotor shaft 5. The stator 12A of the driving motor 12 is disposed inside the stator column 4, and the rotor 12B of the driving motor 12 is integrally fitted to the outer peripheral face side of the rotor shaft 5.

The radial magnetic bearings 10 are provided as a total of two sets, one set above and one set below the driving motor 12. The axial magnetic bearings 11 are provided as one set, at the lower end portion side of the rotor shaft 5.

The two sets of radial magnetic bearings 10 comprise each: a radial electromagnet target 10A that is attached to the outer peripheral face of the rotor shaft 5, and, opposing the radial electromagnet target 10A, a plurality of radial electromagnets 10B, on the inner side face in the stator column 4, and a radial-direction displacement sensor 10C. The radial electromagnet target 10A comprises a laminate steel plate that results from stacking steel sheets of a high-permeability material. The radial electromagnets 10B draw in the rotor shaft 5 in the radial direction, via the radial electromagnet target 10A, by virtue of magnetic forces. The radial-direction displacement sensor 10C detects the radial-direction displacement of the rotor shaft 5. The rotor shaft 5 is supported through levitation by magnetic forces, at a predetermined position in the radial direction, through control of the excitation current of the radial electromagnets 10B on the basis of the detection value (radial-direction displacement of the rotor shaft 5) by the radial-direction displacement sensor 10C.

The axial magnetic bearings 11 comprise: a disc-shaped armature disc 11A that is attached to the outer-peripheral lower end portion of the rotor shaft 5; axial electromagnets 11B disposed opposing each other, flanking the armature disc 11A from above and below; and an axial-direction displacement sensor 11C that is disposed at a position slightly offset from the lower end face of the rotor shaft 5. The armature disc 11A comprises a high-permeability material. The upper and lower axial electromagnets 11B draw the armature disc 11A in the up-and-down direction of the latter, by virtue of magnetic forces. The axial-direction displacement sensor 11C detects the axial-direction displacement of the rotor shaft 5. The rotor shaft 5 is supported through levitation by magnetic forces, at a predetermined position in the axial direction, through control of the excitation current of the upper and lower axial electromagnets 11B on the basis of the detection value (axial-direction displacement of the rotor shaft 5) by the axial-direction displacement sensor 11C.

The rotor 6 is provided, as a cylindrical rotating member, outward of the stator column 4. The rotor 6 (cylindrical rotating member) is shaped as a cylinder that surrounds the outer periphery of the stator column 4, and has a structure such that a ring-like plate body 60 positioned at substantially the middle of the rotor 6 connects two cylinder bodies (first cylindrical body 61 and second cylindrical body 62) of dissimilar diameters, in the axial direction of the cylinder bodies. In the exhaust pump P of FIG. 1, as an example of the connection structure, the plate body 60 is integrally provided at the lower end of the second cylindrical body 62, and a ring-like projection 60A is provided integrally at the reverse side outer peripheral section of the plate body 60. A first cylindrical body 61 is fixed to the outer periphery of the ring-like projection 60A, as a result of which the first cylindrical body 61 and the second cylindrical body 62 become connected in the axial direction.

In the exhaust pump P of FIG. 1, a flange section 60B (FIGS. 3A to 3C) is provided at the outer periphery of the ring-like projection 60A, such that the upper end section of the first cylindrical body 61 abuts the flange section 60B. However, the flange section 60B may be omitted, as in FIGS. 4A to 4C.

At the upper end of the second cylindrical body 62 there is integrally provided another plate body 63, as a member that constitutes the upper end face of the second cylindrical body 62. The rotor 6 and the rotor shaft 5 are integrated together by way of this plate body 63. In the exhaust pump P of FIG. 1, a configuration is adopted wherein, as an example of such an integrated structure, a boss hole 7 is provided in the center of the plate body 63, and a step-like shoulder section (hereafter, "rotor shaft shoulder section 9") is provided at an outer-peripheral upper end portion of the rotor shaft 5. The tip portion of the rotor shaft 5 is fitted into the boss hole 7 of the plate body 63 above the rotor shaft shoulder section 9, and the plate body 63 and the rotor shaft shoulder section 9 are fixed by bolts. The rotor 6 and the rotor shaft 5 become integrated together as a result.

In order to reduce the overall weight of the exhaust pump P of FIG. 1 and to achieve faster rotational speed of the rotor 6, the first cylindrical body 61 is made of a high-strength plastic material such as AFPR (aramid fiber-reinforced plastic), BFRP (boron fiber-reinforced plastic), CFRP (carbon fiber-reinforced plastic), DFRP (polyethylene fiber-reinforced plastic), GFRP (glass fiber-reinforced plastic) or the like. Constituent portions of the rotor other than the first cylindrical body 61, specifically the second cylindrical body 62 and the plate bodies 60, 63, are all made of a lightweight metal material such as aluminum or an alloy thereof.

Figure 5:
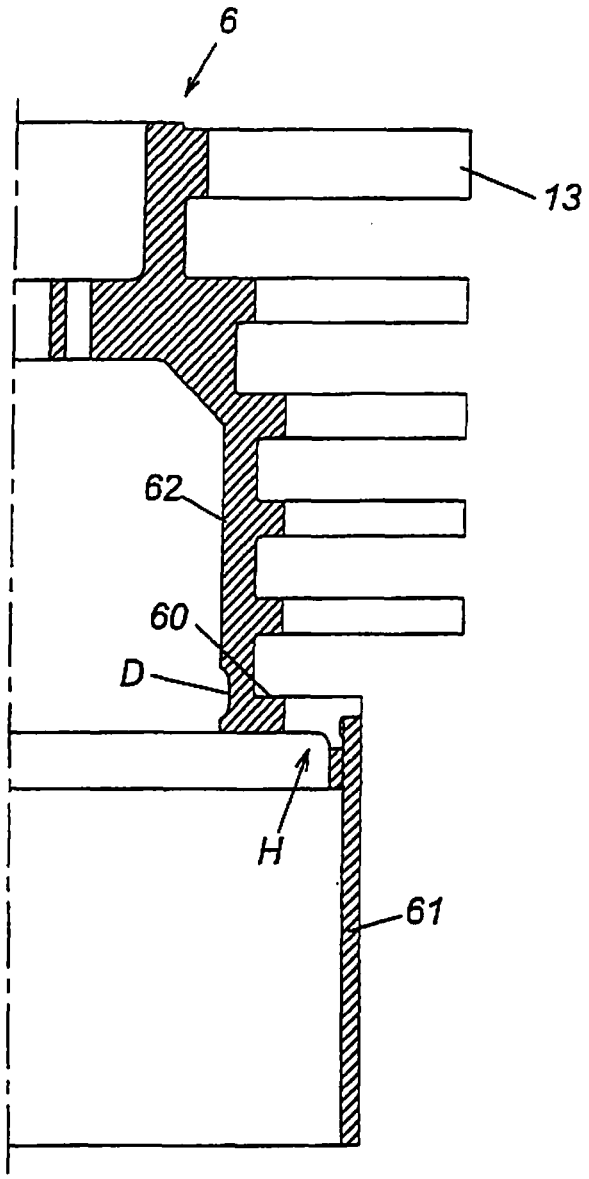
FIG. 5 is an explanatory diagram of a mass addition groove for adjusting rotor balance.

In the exhaust pump P of FIG. 1, the first cylindrical body 61 is made of a high-strength plastic material. Therefore, as illustrated in FIG. 5, a mass addition groove D for balance adjustment of the rotor 6 is provided at the inner peripheral face of the plate body 60 that comprises a metal material. Such a mass addition groove D may further be provided at the inner peripheral face of the second cylindrical body 62. Since the first cylindrical body 61 is made of the metal material, the mass addition groove D may be provided at the inner peripheral face of the first cylindrical body 61.

The rotor 6 is configured is rotatably supported about the axis (rotor shaft 5), by the radial magnetic bearings 10 and axial magnetic bearings 11, via the rotor shaft 5.

In the exhaust pump P of FIG. 1, the rotor shaft 5, the radial magnetic bearings 10 and the axial magnetic bearings 11 function as support means that rotatably supports the rotor 6 about the axis thereof. The rotor 6 rotates integrally with the rotor shaft 5, and hence the driving motor 12 that rotationally drives the rotor shaft 5 functions as driving means for rotationally driving the rotor 6.

<Detailed Configuration of the Blade Evacuation Section Pt>

The exhaust pump P of FIG. 1 is configured in such a manner that the section upstream of substantially the middle of the rotor 6 (cylindrical rotating member) (i.e. the area from substantially the middle of the rotor 6 up to the end portion of the rotor 6 on the gas intake port 2 side) functions as the blade evacuation section Pt. The blade evacuation section Pt is explained in detail below.

The rotor blades 13 are integrally provided, as a plurality thereof, on the outer peripheral face of the rotor 6, (more specifically, the outer peripheral face of the second cylindrical body 62) upstream of substantially the middle of the rotor 6. The rotor blades 13 are juxtaposed radially about the rotation axis (rotor shaft 5) of the rotor 6, or the axis (hereafter, "pump axis") of the outer case 1. The stator blades 14 are provided, as a plurality thereof, on the inner peripheral face side of the pump case 1A. The stator blades 14 are disposed side by side, radially about the pump axis. The blade evacuation section Pt is formed through alternate arrangement of the rotor blades 13 and the stator blades 14, in multiple stages, along the pump axis.

All the rotor blades 13 are blade-shaped cut products formed through cut-out in a cutting process, integrally with the outer-diameter machined portion of the rotor 6. The rotor blades 13 are tilted at an angle that is optimal for evacuation of gas molecules. All the stator blades 14 are likewise tilted at an angle that is optimal for evacuation of gas molecules.

<<Explanation of Evacuation Operation by the Blade Evacuation Section Pt>>

In the blade evacuation section Pt configured as described above, the rotor shaft 5, the rotor 6 and the plurality of rotor blades 13 rotate integrally at high-speed upon startup of the driving motor 12, and the topmost-stage rotor blades 13 impart downward momentum to the gas molecules that impinge through the gas intake port 2. These gas molecules having downward momentum are fed downward by the stator blades 14, towards the rotor blades 13 of a next stage. The above operation of imparting momentum to the gas molecules and sending the gas molecules downward is repeated over multiple stages, as a result of which the gas molecules on the gas intake port 2 side are evacuated by migrating sequentially towards the downstream side of the rotor 6.

<Detailed Configuration of the Thread Groove Evacuation Section Ps>

In the exhaust pump P of FIG. 1, the section downstream of substantially the middle of the rotor 6 (cylindrical rotating member) (i.e. the area from substantially the middle of the rotor 6 up to the end portion of the rotor 6 on the gas discharge port 3 side) functions as the thread groove evacuation section Ps. The thread groove evacuation section Ps is explained in detail next.

The rotor 6 downstream of the substantially the middle of the rotor 6 (more specifically, a portion of the first cylindrical body 61) is configured as a portion that rotates as a rotation member of the thread groove evacuation section Ps, and that is inserted/accommodated between double cylindrical thread groove evacuation section stators 18A and 18B, outward and inward in the thread groove evacuation section Ps, with a predetermined gap with respect to the thread groove evacuation section stators 18A and 18B.

From among the inner and outer double cylindrical thread groove evacuation section stators 18A and 18B, the outer thread groove evacuation section stator 18A, as an outer cylindrical fixed member, is disposed so as to surround the outer periphery of the rotor 6 (a portion downstream of the substantially the middle of the rotor 6). A thread groove 19A the diameter whereof decreases with downward depth, so that the thread groove 19A changes into a tapered cone shape, is formed at the inner peripheral section of the outer thread groove evacuation section stator 18A. The thread groove 19A is helically carved from the upper end to the lower end of the thread groove evacuation section stator 18A, such that the thread groove 19A provides a helical thread groove exhaust passage (hereafter, "outer thread groove exhaust passage S1") between the rotor 6 and the outer thread groove evacuation section stator 18A. The lower end portion of the outer thread groove evacuation section stator 18A is supported on the pump base 1B.

The inner thread groove evacuation section stator 18B, as an inner cylindrical fixed member, is disposed so as to surround the inner periphery of the rotor 6. A thread groove 19B is likewise formed in the outer peripheral section of the inner thread groove evacuation section stator 18B, such that thread groove 19B provides a helical thread groove exhaust passage (hereafter, "inner thread groove exhaust passage S2") between the rotor 6 and the inner thread groove evacuation section stator 18B. The lower end portion of the inner thread groove evacuation section stator 18B is supported on the pump base 1B.

Although not shown in the figures, the thread grooves 19A and 19B explained above may be formed in the outer peripheral face or the inner peripheral face of the rotor 6, to provide thereby an outer thread groove exhaust passage S1 and inner thread groove exhaust passage S2 such as the ones described above.

In the thread groove evacuation section Ps, the depth of the thread groove 19A is set to be greatest on the upstream inlet side of the outer thread groove exhaust passage S1 (passage opening end that is closest to the gas intake port 2) and to be smallest on the downstream outlet side (passage opening end that is closest to the gas discharge port 3), in order for the gas to be transported while being compressed, by virtue of the drag effect at the outer peripheral faces of the thread groove 19A and the rotor 6, and by virtue of the drag effect at the inner peripheral faces of the thread groove 19B and the rotor 6. The same is true of the thread groove 19B.

The upstream inlet of the outer thread groove exhaust passage S1 communicates with a gap (hereafter, "final gap G") that is formed between the lowermost-stage rotor blades 13E, from among the rotor blades 13 that are disposed in multiple stages, and the upstream end of each of connecting opening portions H (to be described later), and the downstream outlet of the passage S1 communicates with the gas discharge port 3 side. The upstream inlet of the inner thread groove exhaust passage S2 opens towards the inner peripheral face of the rotor 6, at substantially the middle of the rotor 6, and the downstream outlet of the passage S2 merges with the downstream outlet of the outer thread groove exhaust passage S1, and communicates thereby with the gas discharge port 3.

Connecting opening portions H are opened in substantially the middle of the rotor 6 (cylindrical rotating member). The connecting opening portions H are formed so as to run through from the front face to the reverse side of the rotor 6; as a result, the connecting opening portions H have the function of causing a part of the gas that exists on the outer periphery of the rotor 6 to be led to the inner thread groove exhaust passage S2.

Specifically, each of the connecting opening portions H having such a function comprises holes H1, H2 that are cut out from the outer peripheral section of the plate body 60 and of the outer peripheral section of the ring-like projection 60A, and a portion of the combined holes H1, H2 that opens in the form of a horizontal hole (specifically, the hole H2) is covered by the outer-peripheral upper end portion of the first cylindrical body 61.

Figure 3:
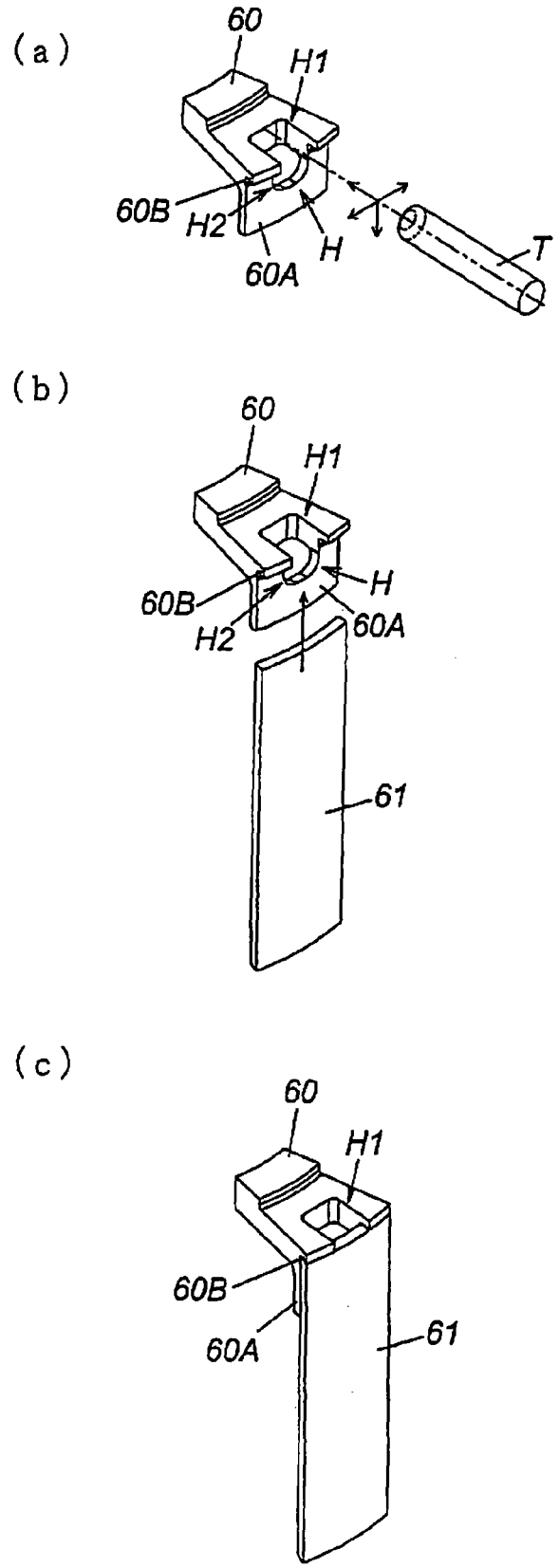
FIGS. 3A and 3B are explanatory diagrams of a work process of forming connecting opening portions H in an example of a configuration having a flange section at the outer periphery of a ring-like projection.
FIG. 3C is an explanatory diagram of the connecting opening portions H that are formed as a result of that work process.

FIGS. 3A and 3B are explanatory diagrams of a work process of forming the connecting opening portions H in a configuration example in which the flange section 60B is provided at the outer periphery of the ring-like projection 60A, and FIG. 3C is an explanatory diagram of the connecting opening portions H that are formed as a result of that work process. FIGS. 4A and 4B are explanatory diagrams of the work process of forming the connecting opening portions H in a configuration example wherein no flange section 60B is provided at the outer periphery of the ring-like projection 60A, and FIG. 4C is an explanatory diagram of the connecting opening portions H that are formed as a result of that work process.

The connecting opening portions H in the structure can be obtained in accordance with Procedure 1 and Procedure 2 below.

Procedure 1

Figure 4:
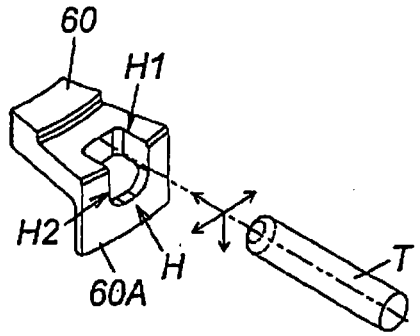
FIGS. 4A and 4B are explanatory diagrams of a work process of forming connecting opening portions in a configuration example lacking a flange section at the outer periphery of a ring-like projection.
FIG. 4C is an explanatory diagram of the connecting opening portions that are formed as a result of that work process.
Figure 4:
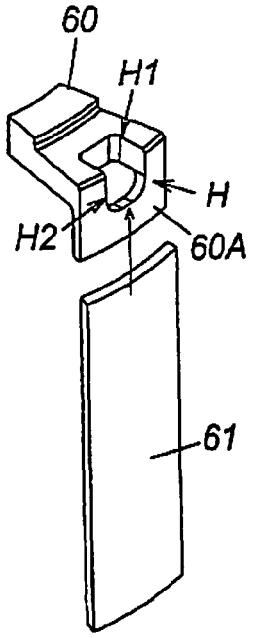
Figure 4:
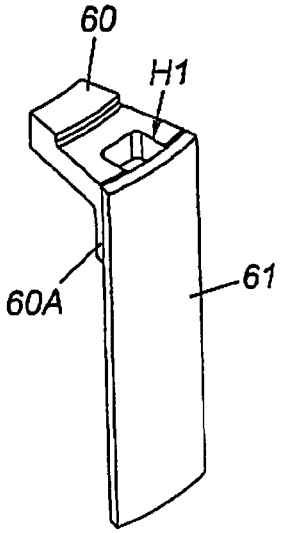

In Procedure 1, the vicinity of the boundary between the plate body 60 and the ring-like projection 60A is cut out beforehand by a tool T, from the outer periphery of the plate body 60, prior to fitting of the first cylindrical body 61 to the outer periphery of the ring-like projection 60A, as illustrated in FIG. 3A or FIG. 4A. In this way, the hole H1 is formed.

The tool T used for forming the holes H1, H2 may be an end mill (tool T) having the shape illustrated in FIG. 3A and FIG. 4A, but some other tool may be used instead. The arrows in FIG. 3A and FIG. 4A denote an infeed direction of the end mill (tool T) during formation of the holes H1, H2. In the example of FIG. 3A and FIG. 4A, the end mill (tool T) is brought close to the vicinity of the boundary between the plate body 60 and the ring-like projection 60A, and an infeed amount of the end mill in three directions (infeed amount in the direction of the axis of the rotor 6, in a direction substantially at right angles thereto, and in the peripheral direction of the rotor 6) is adjusted, to form thereby the holes H1, H2.

The cutting edge at the tip portion of the end mill (tool T) illustrated in FIG. 4A is shaped as a circular arc, and hence the holes H1, H2 have a corner-less hole shape. Stress concentration that might occur in the holes H1, H2 is relieved thereby.

The operation of removing burr generated during the formation process of the holes H1, H2 can be performed beforehand, prior to fitting of the first cylindrical body 61 onto the outer periphery of the ring-like projection 60A. Burr can be easily removed, in such an instance, by inserting a deburring tool into the holes H1, H2, through the portion of the combined holes H1, H2 that opens in the form of a horizontal hole (specifically, the hole H2).

The holes H1, H2 can be formed by bringing the tool T close to the vicinity of the boundary between the plate body 60 and the ring-like projection 60A, from the outer periphery of the plate body 60. Therefore, even if rotor blades 13E stand above the portion of the combined holes H1, H2 that opens in the form of a vertical hole (specifically, the hole H1), such rotor blades 13 constitute no obstacle to the formation of the holes H1, H2. The connecting opening portions H that comprise such holes H1, H2 can be thus formed easily.

Procedure 2

In Procedure 2, the holes H1, H2 are formed according to Procedure 1, and thereafter, the second cylindrical body 62 is fitted to the ring-like projection 60A, as illustrated in FIG. 3B or FIG. 4B. As a result, the portion of the combined holes H1, H2 that opens in the form of a horizontal hole (specifically, the hole H2), becomes covered by the outer-peripheral upper end portion of the first cylindrical body 61.

Figure 2:
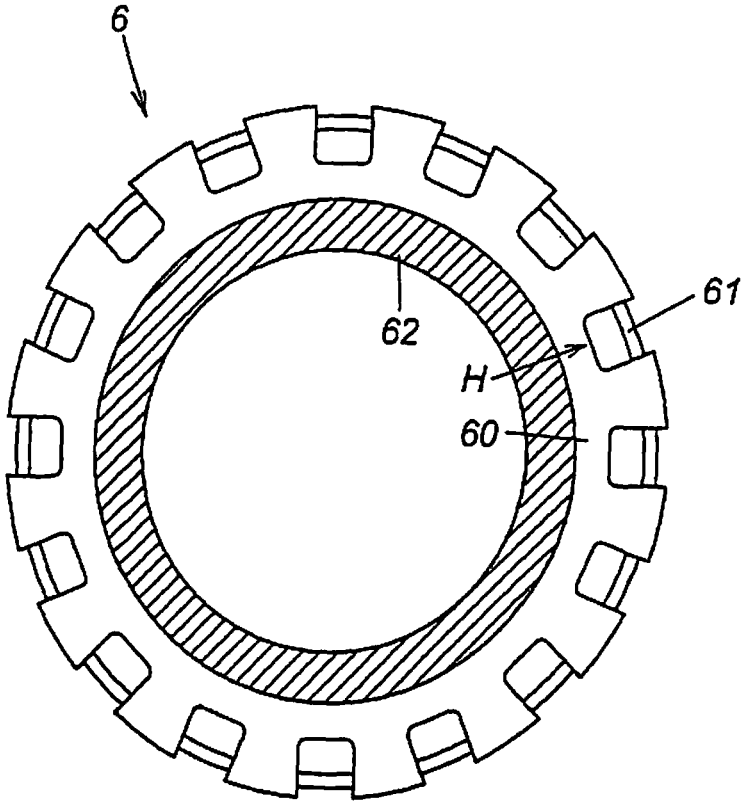
FIG. 2 is a cross-sectional diagram, along AA, of a rotor (cylindrical rotating member) that makes up the exhaust pump of FIG. 1.

In the exhaust pump P of FIG. 1, the connecting opening portions H explained above are provided as a plurality of openings, in such a manner that the positions of the plurality of connecting opening portions H are disposed point-symmetrically with respect to the pump axis of the exhaust pump P, as illustrated in FIG. 2. As a result, the position of the center of gravity of the rotor 6 is unlikelier to shift in the radial direction, and balance correction becomes easier.

<Explanation Regarding the Evacuation Operation in the Thread Groove Evacuation Section Ps>

The gas molecules, having reached the final gap G and the upstream inlet of the outer thread groove exhaust passage S1 by being transported on account of the evacuation action of the blade evacuation section Pt, as explained above, move then into the outer thread groove exhaust passage S1, and into the inner thread groove exhaust passage S2 through the connecting opening portions H. As a result of the rotation of the rotor 6, specifically, as a result of the drag effect at the thread groove 19A and the outer peripheral face of the rotor 6, and the drag effect at the thread groove 19B and the inner peripheral face of the rotor 6, the incoming gas molecules are caused to move towards the gas discharge port 3 while being compressed from transitional flow to viscous flow, and are ultimately discharged out via an auxiliary pump not shown.

As explained above, the connecting opening portions H have a structure wherein the portion of the combined holes H1, H2 that opens in the form of a horizontal hole (specifically, the hole H2) is covered by the outer-peripheral upper end portion of the first cylindrical body 61. Therefore, the gas evacuation action elicited by the drag effect is likewise effective at that portion, as part of the outer thread groove exhaust passage S1.

Second Embodiment

Figure 6:
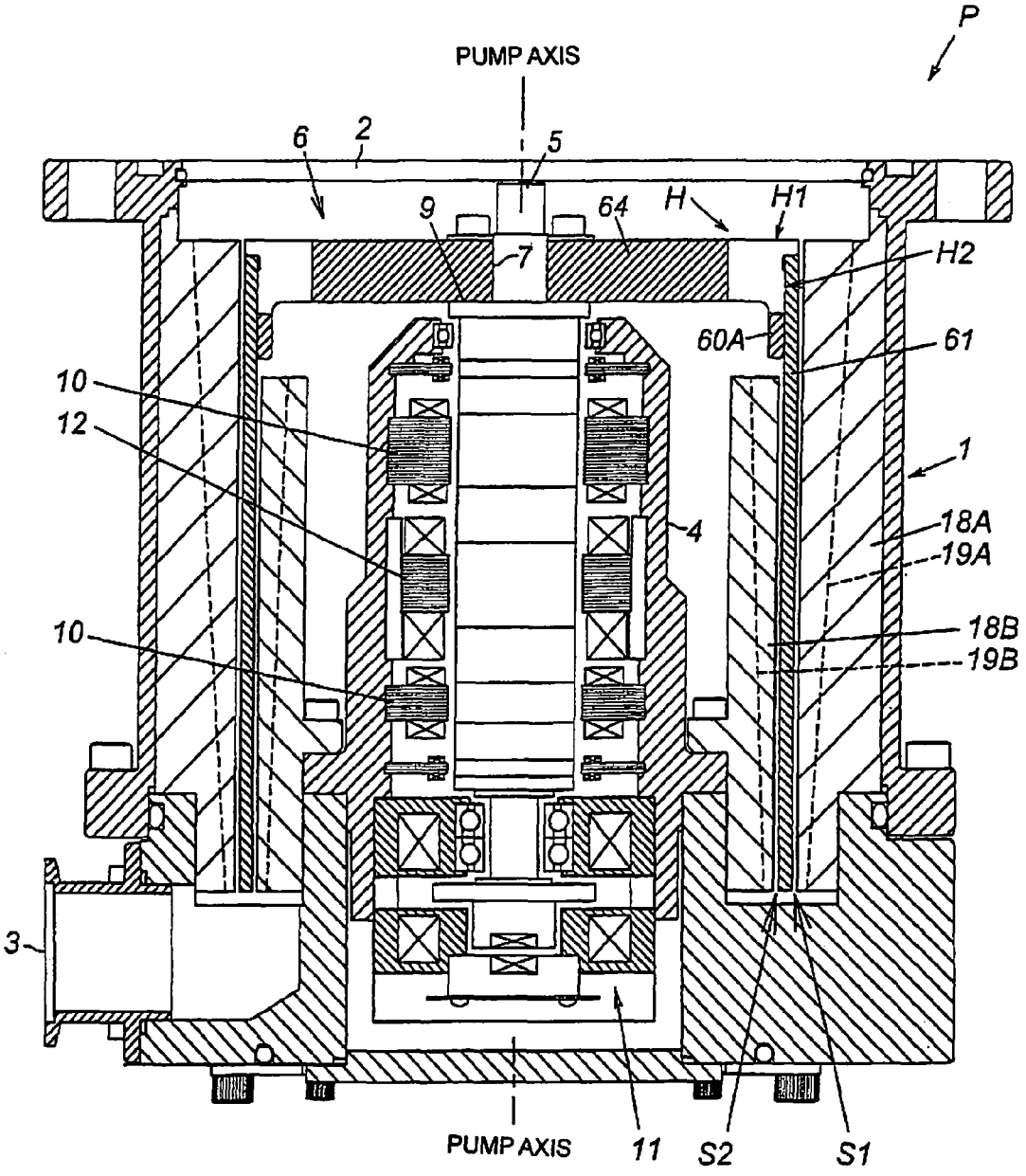
FIG. 6 is a cross-sectional diagram of an exhaust pump being a second embodiment of the present invention.

FIG. 6 is a cross-sectional diagram of an exhaust pump in a second embodiment of the present invention. The exhaust pump P in FIG. 6 is an exhaust pump (drag pump) of a type wherein the exhaust pump P (first embodiment) of FIG. 1 explained above is provided with the thread groove evacuation section Ps alone. Therefore, members shared with the exhaust pump P of FIG. 1 are denoted with the same reference numerals, and a detailed explanation thereof will be omitted.

In a basic pump configuration, the exhaust pump P of FIG. 6 comprises: the rotor 6 (cylindrical rotating member); support means (radial magnetic bearings 10 and axial magnetic bearings 11) for rotationally supporting the rotor 6 about the axis (rotor shaft 5) thereof; the driving motor 12 (driving means) that rotationally drives the rotor 6; the outer thread groove evacuation section stator 18A (outer cylindrical fixed member) disposed so as to surround the outer periphery of the rotor 6; the inner thread groove evacuation section stator 18B (inner cylindrical fixed member) disposed so as to surround the inner periphery of the rotor 6; the helical outer thread groove exhaust passage S1 provided between the rotor 6 and the outer thread groove evacuation section stator 18A; the helical inner thread groove exhaust passage S2 provided between the rotor 6 and the inner thread groove evacuation section stator 18B; and the connecting opening portions H, opened in the rotor 6, that lead a part of the gas that exists in the vicinity of the outer periphery of the rotor 6 towards the inner thread groove exhaust passage S2.

Like the rotor 6 of the exhaust pump P of FIG. 1, the rotor 6 of the exhaust pump P of FIG. 6 comprises the plate body 64 having the ring-like projection 60A in the reverse side outer peripheral section, and a cylindrical body 61 (corresponding to the first cylindrical body 61 in the exhaust pump P of FIG. 1) that is fixed to the outer periphery of the ring-like projection 60A.

In the exhaust pump P of FIG. 6, the plate body 64 makes up the upper end face of the cylindrical body 61, and the boss hole 7 is provided in the center of the plate body 64. The tip portion of the rotor shaft 5 above the rotor shaft shoulder section 9 is fitted into the boss hole 7 of the plate body 64, and the plate body 64 and the rotor shaft shoulder section 9 are fixed by way of bolts, as a result of which the rotor 6 and the rotor shaft 5 are integrated together.

The exhaust pump P of FIG. 6 has no blade evacuation section Pt such as the one in the exhaust pump P of FIG. 1. Therefore, the rotor 6 in the exhaust pump P of FIG. 6 may have a shape wherein the second cylindrical body 62 of the rotor 6 of the exhaust pump P of FIG. 1 is omitted.

The connecting opening portions H of the exhaust pump P of FIG. 6 are configured in the same way as the connecting opening portions H of the exhaust pump P of FIG. 1. That is, the connecting opening portions H of the exhaust pump P of FIG. 6 comprise the holes H1, H2 (FIGS. 3A and 3B) that are cut out from the outer peripheral section of the plate body 64 and the outer peripheral section of a ring-like projection 62A, and a portion of the combined holes H1, H2 that opens in the form of a horizontal hole (specifically, the hole H2) is covered by the outer-peripheral upper end portion of the cylindrical body 61.

What is claimed is:

1. An exhaust pump, comprising:

rotor blades;

stator blades;

a cylindrical rotating member comprising:

a plate body having a ring-like projection at a reverse side outer peripheral section of said cylindrical rotating member; and a cylindrical body being fitted into an outer periphery of the ring-like projection;

support means for rotatably supporting said cylindrical rotating member about an axis thereof;

a driving means for rotationally driving said cylindrical rotating member;

an outer cylindrical fixed member disposed so as to surround the outer periphery of said cylindrical rotating member;

an inner cylindrical fixed member disposed so as to be surrounded by an inner periphery of said cylindrical rotating member;

a helical outer thread groove exhaust passage provided between said cylindrical rotating member and said outer cylindrical fixed member;

a helical inner thread groove exhaust passage provided between said cylindrical rotating member and said inner cylindrical fixed member; and connecting opening portions that are opened in said cylindrical rotating member and that lead a part of gas existing in the vicinity of the outer periphery of said cylindrical rotating member to said inner thread groove exhaust passage, each of said connecting opening portions comprises a vertical hole in an outer peripheral section of said plate body and a horizontal hole in an outer peripheral section of said ring-like projection, and in the each of said connecting opening portions at least a portion of said horizontal hole is covered by an outer-peripheral upper end portion of said cylindrical body.

2. The exhaust pump according to claim 1, wherein, of the entirety of said cylindrical rotating member, said plate body and said ring-like projection are made of a metal material, and said cylindrical body is made of a high-strength plastic material.

3. The exhaust pump according to claim 2, wherein said plate body is formed in a ring shape, and the plate body further comprises an inner peripheral face having a mass addition groove for balance adjustment of said cylindrical rotating member.

* * * * *